US011217938B2

(12) United States Patent
Narama

(10) Patent No.: US 11,217,938 B2
(45) Date of Patent: Jan. 4, 2022

(54) CONNECTOR WITH BACKLASH FILLING PROTRUSION

(71) Applicant: YAZAKI CORPORATION, Tokyo (JP)

(72) Inventor: Shunsuke Narama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/070,942

(22) Filed: Oct. 15, 2020

(65) Prior Publication Data

US 2021/0119379 A1 Apr. 22, 2021

(30) Foreign Application Priority Data

Oct. 17, 2019 (JP) ..... JP2019-190392

(51) Int. Cl.
*H01R 13/58* (2006.01)
*H01R 13/629* (2006.01)
*H01R 13/28* (2006.01)

(52) U.S. Cl.
CPC ..... *H01R 13/629* (2013.01); *H01R 13/28* (2013.01)

(58) Field of Classification Search
CPC .. H01R 13/629; H01R 13/627; H01R 13/625; H01R 13/62; H01R 13/6275; H01R 13/6272; H01R 13/28
USPC ..... 439/259
See application file for complete search history.

(56) References Cited

U.S. PATENT DOCUMENTS 5,120,255 A * 6/1992 Kouda ..... H01R 13/641 439/489
5,234,356 A * 8/1993 Maejima ..... H01R 13/6272 439/352
5,507,666 A * 4/1996 Yamanashi ..... H01R 13/641 439/489
6,261,116 B1 * 7/2001 Ceru ..... H01R 13/6272 439/352
6,439,915 B2 * 8/2002 Kurimoto ..... H01R 13/6272 439/352
7,326,074 B1 * 2/2008 Lim ..... H01R 13/629 439/352

(Continued)

FOREIGN PATENT DOCUMENTS

EP 0854546 A2 7/1998
EP 2637260 A1 9/2013

(Continued)

*Primary Examiner* — Harshad G Patel
(74) *Attorney, Agent, or Firm* — Kenealy Vaidya LLP

(57) ABSTRACT

A connector includes a connector housing having a lock portion configured to lock a mated housing; a guide groove formed in the connector housing and guiding a fitting detection member from a temporary locking position to a final locking position; an arm portion having an engagement protrusion provided on an extended free end extending in a direction of approaching the lock portion from the fitting detection member and abutting against the lock portion at the temporary locking position; and a backlash filling protrusion that is formed on a protruding plate portion, to be engaged with the guide groove, of the fitting detection member, and is configured to tilt the fitting detection member in a direction in which a locking amount of the engagement protrusion with respect to the lock portion is increased at the temporary locking position.

4 Claims, 10 Drawing Sheets

(56) References Cited

U.S. PATENT DOCUMENTS

| | | | | |
|---|---|---|---|---|
| 7,399,195 | B2 * | 7/2008 | Kim | H01R 13/641 439/352 |
| 8,016,606 | B1 * | 9/2011 | Kwan | H01R 13/641 439/352 |
| 9,876,313 | B2 * | 1/2018 | Endo | H01R 13/629 |
| 10,468,805 | B2 * | 11/2019 | Evans | H01R 13/4368 |
| 10,516,229 | B2 * | 12/2019 | Nakamura | H01R 13/4223 |
| 10,784,625 | B2 * | 9/2020 | Narama | H01R 13/639 |

FOREIGN PATENT DOCUMENTS

| | | | |
|---|---|---|---|
| EP | 3 171 459 | A1 | 5/2017 |
| EP | 3211730 | A1 | 8/2017 |
| JP | 2017-98222 | A | 6/2017 |

* cited by examiner

CONNECTOR WITH BACKLASH FILLING PROTRUSION

CROSS-REFERENCE TO RELATED APPLICATIONS

This application is based on and claims priority under 35 USC 119 from Japanese Patent Application No. 2019-190392 filed on Oct. 17, 2019, the contents of which are incorporated herein by reference.

TECHNICAL FIELD

The present invention relates to a connector.

BACKGROUND ART

A connector, which includes a fitting detection member (CPA: Connector Position Assurance) for detecting and ensuring a normal fitting with a mated connector, has been known (For example, see Patent Literature 1).

FIG. 10 is an exploded perspective view of an electric connector 501 according to the related art which is disclosed in Patent Literature 1. The electric connector 501 includes a terminal position assurance (TPA) device in addition to a fitting detection member (also referred to as CPA device) 503.

A terminal position assurance device (also referred to as TPA device) 505 is movable from a terminal insertion position to a terminal locking position in a cavity portion 509 of a connector housing 507. When being at the terminal locking position, the TPA device 505 engages with a locking surface of an electric terminal 511 and fixes the electric terminal 511 in the cavity portion 509. On the other hand, when the connector is coupled to a mated connector (not illustrated), the CPA device 503 can move from a temporary locking position to a final locking position (fitting assurance position).

In the temporary locking position, a locking portion 513 of the CPA device 503 is locked to a locking protrusion 515 of the connector housing 507. When an engagement protrusion 519 of an arm portion 517 engages with the connector housing 507, the movement of the CPA device 503 to the final locking position is restricted. On the other hand, when a mated housing is fitted into the connector housing 507, the engagement protrusion 519 of the arm portion 517 is pressed by a lock claw or the like of the mated housing and the engagement between the engagement protruding portion 519 and the connector housing 507 is released. Accordingly, the CPA device 503 can move to the final locking position. As a result, when the CPA device 503 reaches the final locking position, the CPA device 503 is configured such that the mated housing is normally fitted into the connector housing 507.

CITATION LIST

Patent Literature

Patent Literature 1: JP-A-2017-98222

However, in the electric connector 501 according to the related art, when the CPA device 503 is in a temporarily locked state and there is a backlash between the CPA device 503 and the connector housing 507, the CPA device 503 may tilt and a locking amount with the connector housing 507 may be reduced. Therefore, the CPA device 503 may shift to an unintended final locked state, and the operation reliability may be reduced. When a thickness of a mounting wall portion forming a detection member mounting surface on which the CPA device 503 is mounted is small, the electric connector 501 is likely to be bent. Therefore, when the connector is detached from the mated connector, a part of a detaching force may be applied to the CPA device 503, and the CPA device 503 may be pulled out from the connector housing 507, thereby reducing the operation reliability.

SUMMARY OF INVENTION

According to the embodiments, the connector can improve the operation reliability of the fitting detection member.

According to the embodiments, a connector includes: a connector housing having a lock portion to be engaged with a mated housing; a guide groove that is formed in the connector housing and guides a fitting detection member from a temporary locking position to a final locking position; an arm portion that includes an engagement protrusion provided on an extended free end of the arm portion and abutting against the lock portion at the temporary locking position, the extended free end extending from the fitting detection member in a direction of approaching the lock portion; and a backlash filling protrusion that is formed on a protruding plate portion, to be engaged with the guide groove, of the fitting detection member, and tilts the fitting detection member in a direction in which a locking amount of the engagement protrusion with respect to the lock portion is increased at the temporary locking position.

DESCRIPTION OF EMBODIMENTS

Embodiments of the present invention will be described below with reference to the drawings.

Figure 1:
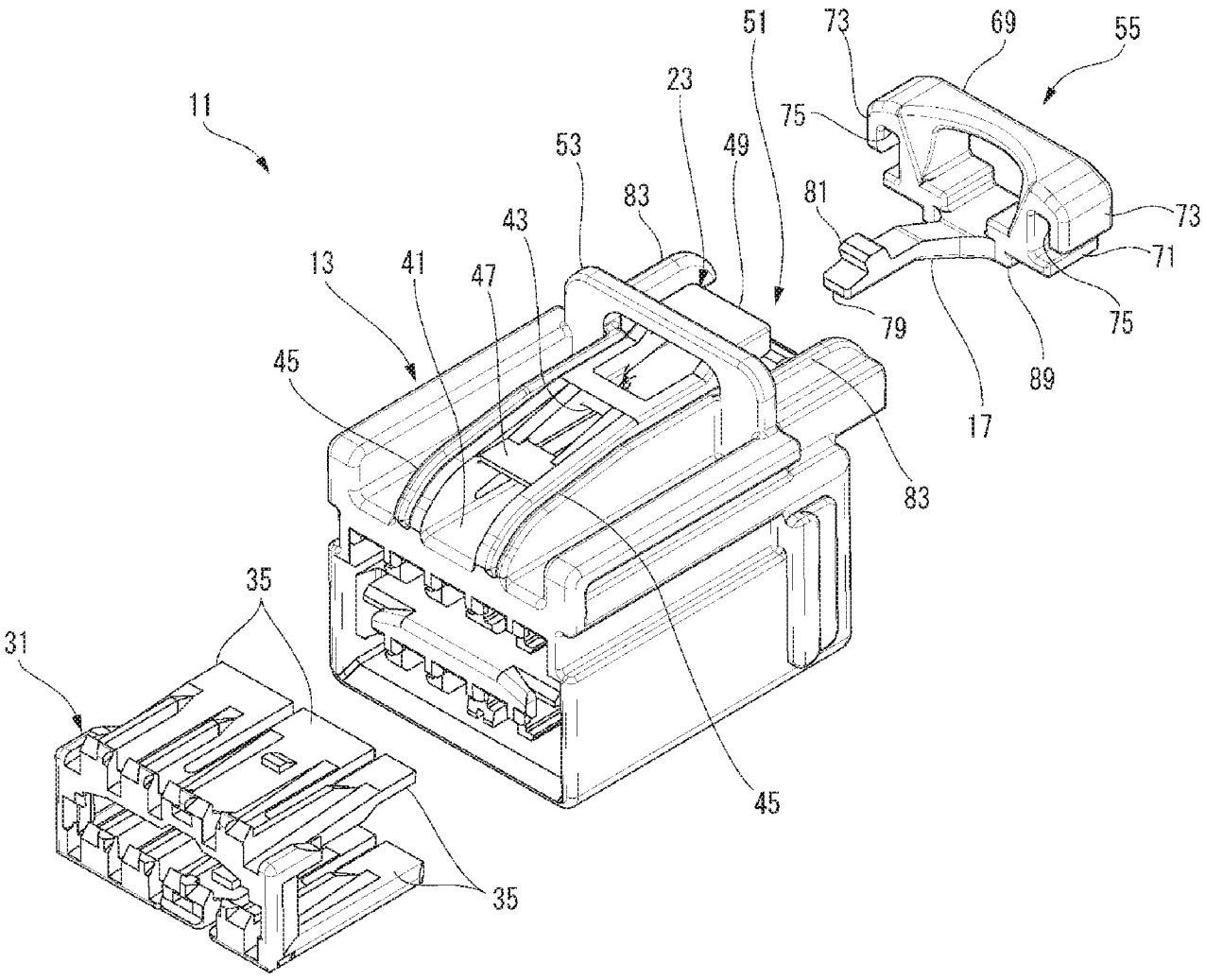
FIG. 1 is an exploded perspective view of a connector according to a first embodiment of the present invention.

FIG. 1 is an exploded perspective view of a connector 11 according to a first embodiment of the present invention.

Figure 2:
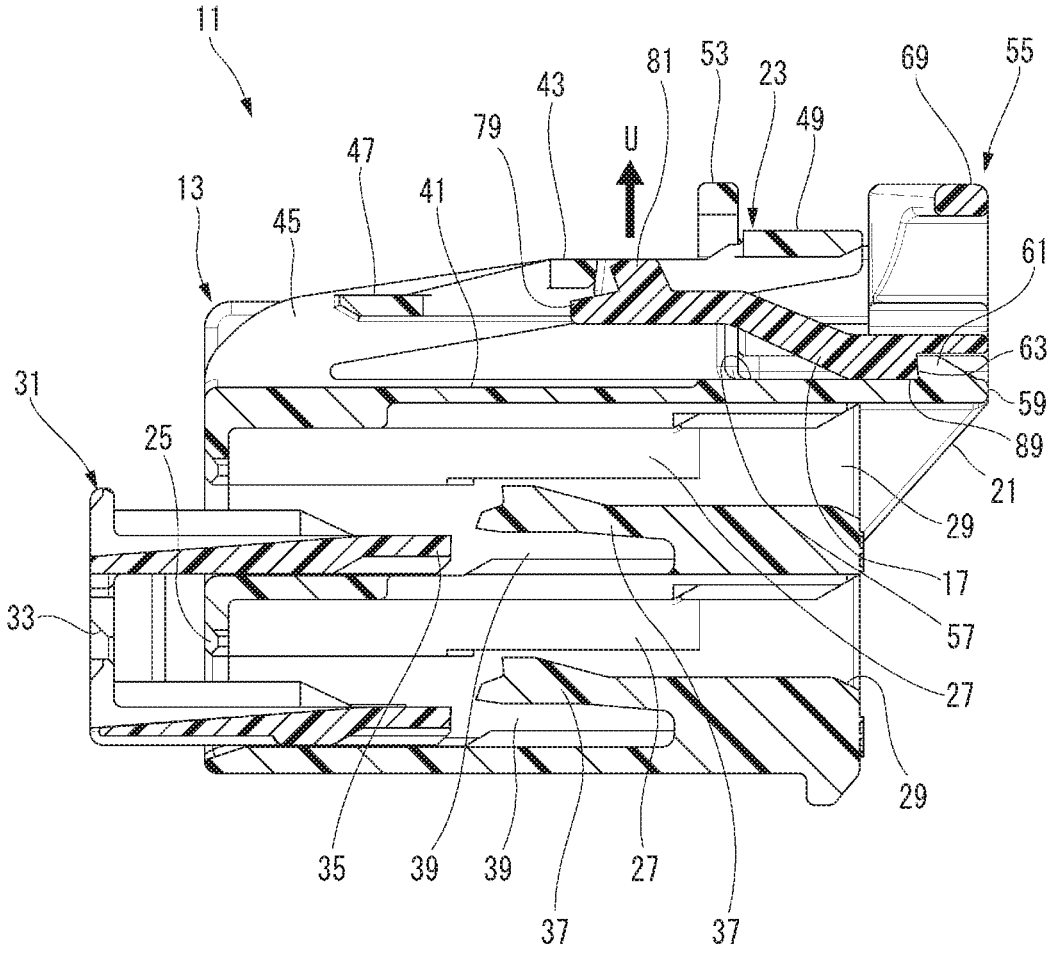
FIG. 2 is a longitudinal sectional view of a connector housing holding a fitting detection member at a temporary locking position by a backlash filling protrusion.

The connector 11 according to the first embodiment mainly includes a connector housing 13, a guide groove 15 (see FIG. 5), an arm portion 17, a backlash filling protrusion 19 (see FIG. 6), and a support wall 21 (see FIG. 2).

The connector housing 13 is integrally formed of a synthetic resin material and has a substantially rectangular parallelepiped outer shape. One face of the connector housing 13 in a longitudinal direction is a front face on a side to be fitted into a mated housing (not illustrated), and the other face on a side opposite to the above side is a rear face into which a terminal (not illustrated) to be mounted is to be inserted. One face of the connector housing 13 in a direction perpendicular to the longitudinal direction is an upper face including a lock arm 23 for fixing the fitting with the mated housing, and the other face thereof in the direction perpendicular to the longitudinal direction is a lower face. Left and right faces of the connector housing 13 in directions perpendicular to the longitudinal direction and an upper-lower direction and facing the front from the connector housing 13 are side faces.

A plurality of terminal receiving ports 25 (see FIG. 2) for receiving, for example, male terminals (not illustrated) accommodated in the mated housing are opened vertically and horizontally on the front face of the connector housing 13.

Here, the mated connector for accommodating the male terminals is referred to as a male connector. In this case, a terminal attached to the connector housing 13 is a female terminal that is in electric contact with the male terminal. The connector 11 for accommodating the female terminal is referred to as a female connector. The connector 11 may be a male connector for accommodating a male terminal, and in this case, the mated connector is a female connector.

FIG. 2 is a longitudinal sectional view of the connector housing 13 holding a fitting detection member at a temporary locking position by the backlash filling protrusion 19.

For example, a total of 10 terminal receiving ports 25 are provided in an arrangement of two rows in the upper-lower direction and five receiving ports in a left-right direction. Each of the terminal receiving ports 25 communicates with a terminal accommodating chamber 27 defined inside the connector housing 13, and each terminal accommodating chamber 27 is opened as a terminal inserting opening 29 (see FIG. 5) on the rear face. That is, 10 terminal accommodating chambers 27 are formed in the connector housing 13. The number and arrangement of the terminal accommodating chambers 27 are not limited to this example.

Figure 3:
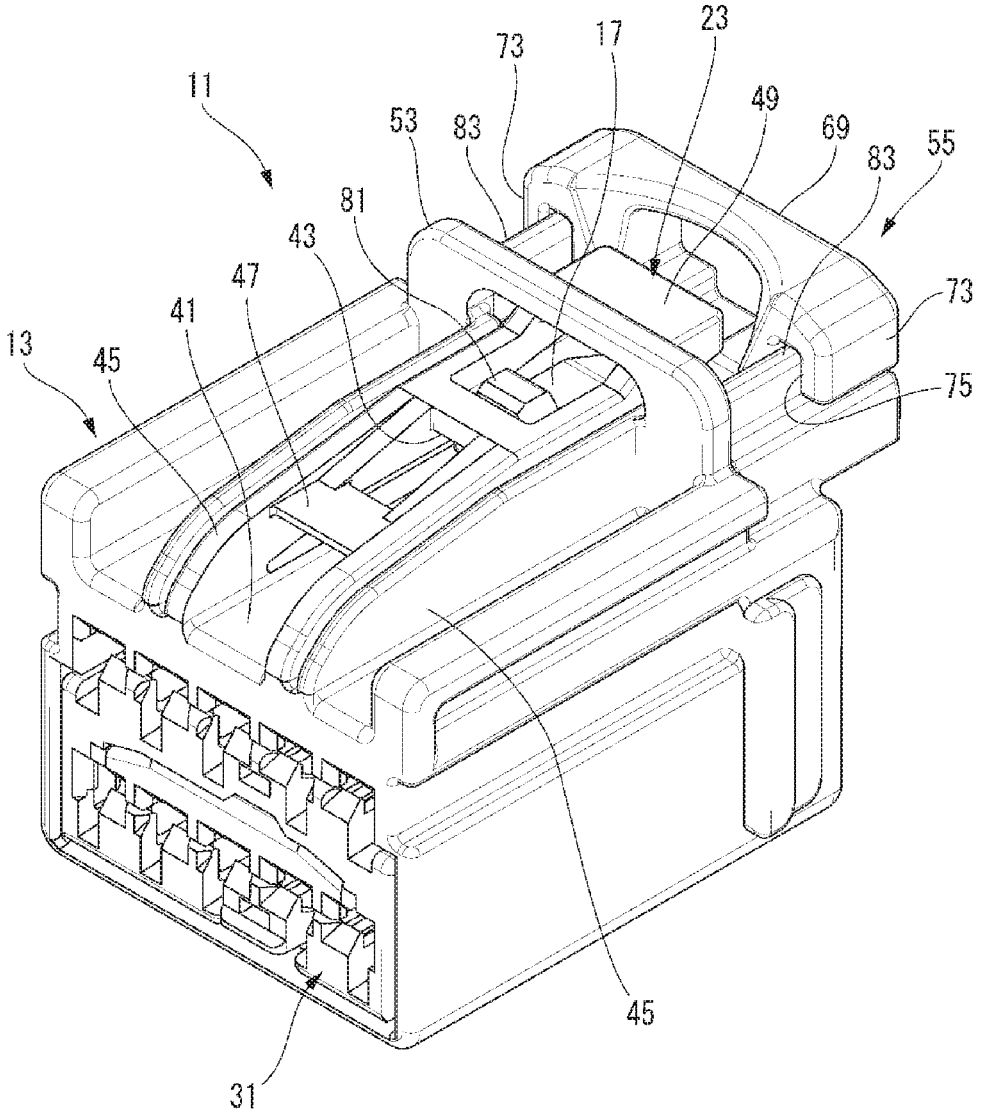
FIG. 3 is an external perspective view of the connector illustrated in FIG. 1, which is in a state in which a front holder and a fitting detection member are mounted thereon.

FIG. 3 is an external perspective view of the connector 11 illustrated in FIG. 1, which is in a state in which a front holder 31 and a fitting detection member are mounted thereon.

The front holder 31 as a terminal position assurance (TPA) device is mounted on the front face of the connector housing 13. The front holder 31 includes communication ports 33 for communicating with the respective terminal receiving ports 25. The male terminal in the mated connector is inserted into the terminal receiving port 25 through the communication port 33. A plurality of lance contact plates 35 (see FIG. 1) to be inserted into the respective terminal accommodating chambers 27 protrude on the front holder 31. When the front holder 31 is mounted on the front face, the lance contact plate 35 comes into contact with an elastic flexible locking piece 37 (also referred to as lance) illustrated in FIG. 2 provided in the respective terminal accommodating chambers 27.

When the front holder 31 is inserted into the front face of the connector housing 13, the lance contact plate 35 illustrated in FIG. 1 is inserted into a retraction space 39 (see FIG. 2) formed by the elastic flexible locking piece 37 normally locked to the terminal. When the elastic flexible locking piece 37 is incompletely locked to the terminal inserted into the terminal accommodating chamber 27, a part of the elastic flexible locking piece 37 protrudes to the retraction space 39. As a result, the lance contact plate 35 is interfered by the elastic flexible locking piece 37, and the front holder 31 inserted into the front face cannot be mounted on the front face. Accordingly, when the front holder 31 cannot be mounted on the front face, it is detected that the terminals are incompletely locked. When all the elastic flexible locking pieces 37 are completely locked to the terminals, the mounting of the front holder 31 to the front face is completed. The lance contact plates 35 are fitted into the retraction spaces 39, and thereby the front holder 31 mounted on the front face restricts the movement of the elastic flexible locking pieces 37 in an unlocking direction and doubly prevents the terminals from slipping out.

The connector housing 13 includes a lock portion 43 for locking the mated housing above a fitting surface side upper face 41 to which the mated housing is externally fitted. The lock portion 43 is provided on the lock arm 23. The lock arm 23 has a base end connected to a front portion of the connector housing 13 and is formed in a cantilever shape extending upward and rearward. An extended end of the lock arm 23 serves as a free end and can be elastically displaced up and down. The lock arm 23 is formed by coupling a bridge portion 47 to an operation portion 49 on the free end side with a pair of side plate portions 45 parallel to each other. The lock portion 43 is formed between the bridge portion 47 and the operation portion 49 across the pair of side plate portions 45.

A detection member mounting portion 51 shown in FIG. 1 is opened on the rear face of the connector housing 13 of the connector 11. In the connector housing 13, a CPA stopper wall 53 is formed upright in front of the detection member mounting portion 51. A fitting detection member (Connector Position Assurance (CPA)) for detecting and ensuring a normal fitting with the mated connector is mounted on the detection member mounting portion 51. A fitting detection member (also referred to as CPA device) 55 is moved from a temporary locking position (a position illustrated in FIG. 5) to a final locking position (not illustrated) in the detection member mounting portion 51.

The CPA device 55 is moved from the temporary locking position to the final locking position by sliding on a detection member mounting surface 57 of the detection member mounting portion 51. The detection member mounting surface 57 is an upper side face of a mounting wall portion 59 extending further rearward from the rear face of the connector housing 13.

A locking protrusion 61 (see FIG. 2) projects from a central rear portion of the detection member mounting surface 57. The locking protrusion 61 is locked to a locking portion 63 formed on a rear lower face of the CPA device 55. The CPA device 55 in which the locking portion 63 is locked to the locking protrusion 61 is restricted from slipping out rearward from the detection member mounting portion 51.

Figure 4:
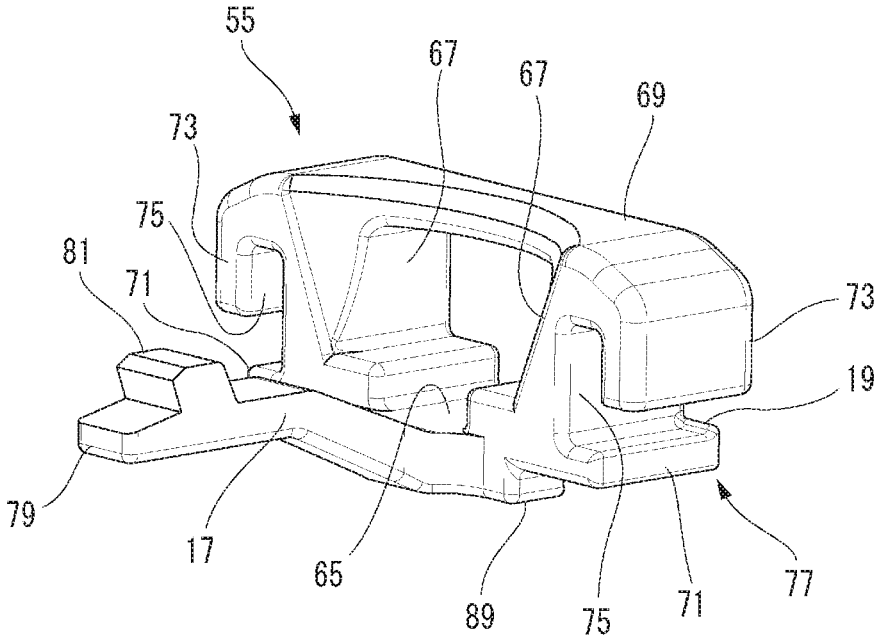
FIG. 4 is a perspective view of the fitting detection member illustrated in FIG. 1.

FIG. 4 is a perspective view of the fitting detection member illustrated in FIG. 1.

In the CPA device 55, a pair of erected wall portions 67 parallel to each other are formed on both sides of a rectangular bottom plate portion 65 that is long in the left-right direction. An advance/retraction operation portion 69 is bridged between upper ends of the erected wall portions 67. Both sides of the bottom plate portion 65 are protruding plate portions 71 protruding outward from the erected wall portions 67 respectively. The advance/retraction operation portion 69 includes hanging portions 73 protruding outward from the erected wall portions 67 respectively. An engagement groove 75 that opens downward is formed between each of the hanging portions 73 and each of the erected wall portions 67.

The CPA device 55 includes the arm portion 17 extending above the fitting surface side upper face 41 from the bottom plate portion 65 of a CPA body portion 77. An engagement protrusion 81 is formed on an upper side face of an extended free end 79 of the arm portion 17. The engagement protrusion 81 abuts against the lock portion 43 at the temporary locking position of the CPA device 55.

Figure 5:
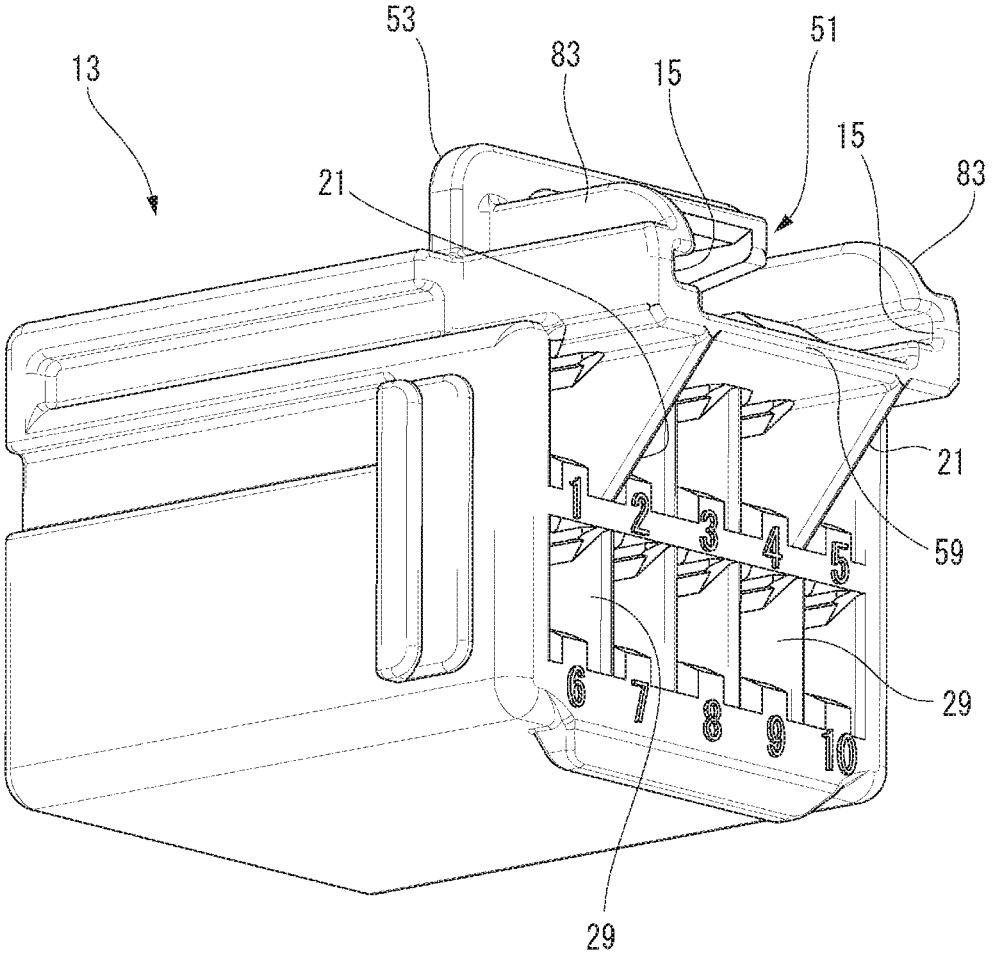
FIG. 5 is a perspective view of the connector housing illustrated in FIG. 1 when viewed from a rear side.

FIG. 5 is a perspective view of the connector housing 13 illustrated in FIG. 1 when viewed from a rear side.

The advance/retraction operation portion 69 of the CPA device 55 is gripped by fingers, and the bottom plate portion 65 slides on the detection member mounting surface 57. The pair of protruding plate portions 71 of the CPA device 55 are respectively inserted into the pair of guide grooves 15 formed on an inner face of the detection member mounting portion 51. The guide grooves 15 guide the CPA device 55 from the temporary locking position to the final locking position. The pair of engagement grooves 75 of the CPA device 55 respectively engage with a pair of guide walls 83 (see FIG. 3) erected at the connector housing 13 on both sides of the detection member mounting portion 51.

The connector 11 includes the mounting wall portion 59 extending further rearward from the rear face of the connector housing 13. Support walls 21 are formed on a lower face of the mounting wall portion 59. The support wall 21 is formed across an extended lower face of the mounting wall portion 59 and a rear end face of the connector housing 13.

Figure 6:
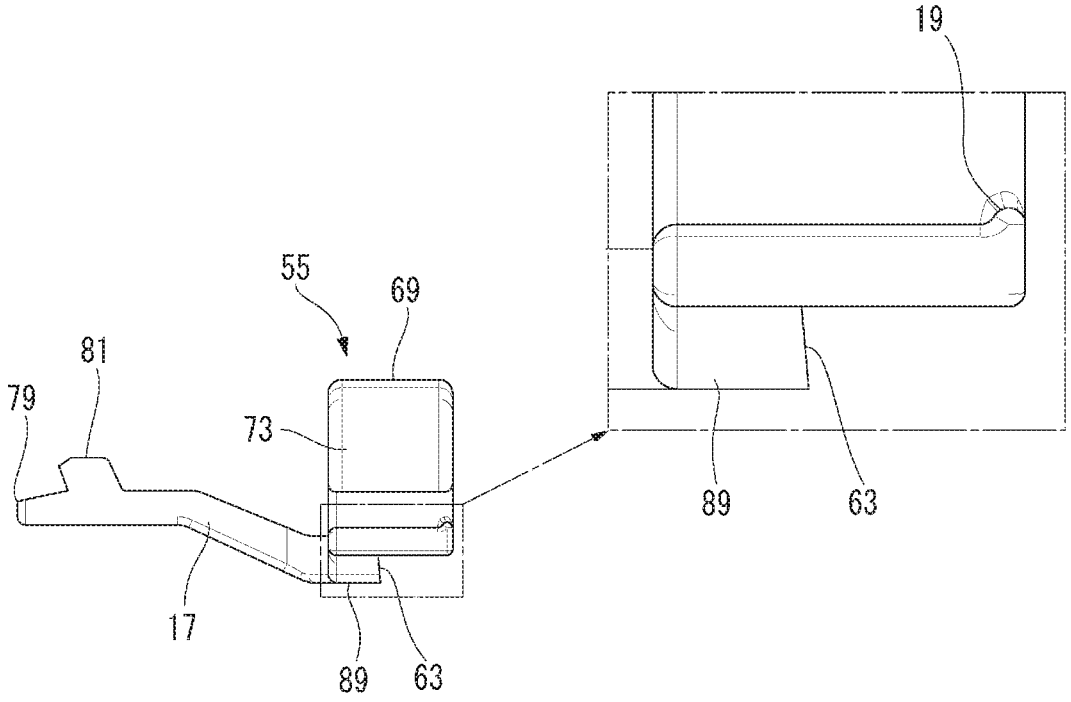
FIG. 6 is a longitudinal view of the fitting detection member illustrated in FIG. 4 and an enlarged view of main parts of the fitting detection member.

FIG. 6 is a side view of the fitting detection member illustrated in FIG. 4 and an enlarged view of main parts of the fitting detection member.

The CPA device 55 includes the backlash filling protrusion 19. The backlash filling protrusion 19 is formed on the protruding plate portion 71, to be engaged with the guide groove 15, of the CPA device 55. As illustrated in FIG. 4, the pair of protruding plate portions 71 respectively project outward substantially perpendicularly from the lower portions of the pair of erected wall portions 67. The protruding plate portion 71 has a rectangular shape long in a sliding direction of the CPA device 55 in a plan view. The backlash filling protrusion 19 protrudes from the protruding plate portion 71 along a rear side portion of the protruding plate portion 71.

Figure 7:
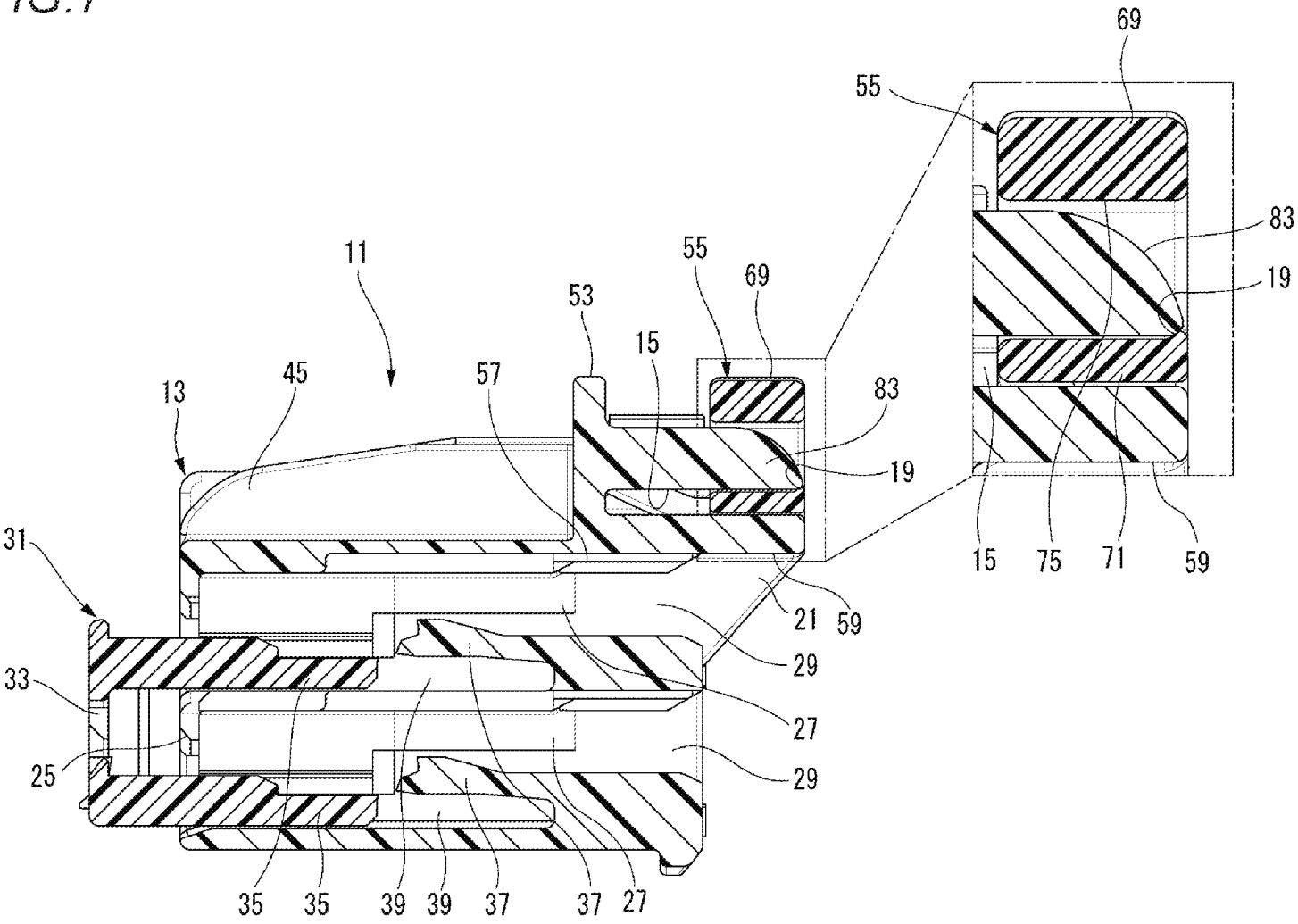
FIG. 7 is a longitudinal sectional view of the connector housing on which a fitting detection member whose backlash is filled with the backlash filling protrusion is mounted, and an enlarged view of main parts of the connector housing.

FIG. 7 is a longitudinal sectional view of the connector housing 13 on which a fitting detection member whose backlash is filled with the backlash filling protrusion 19 is mounted, and an enlarged view of main parts of the connector housing.

When the CPA device 55 is mounted on the detection member mounting portion 51 at the temporary locking position, the backlash filling protrusion 19 contacts an upper groove surface of the guide groove 15. When the backlash filling protrusion 19 contacts the upper groove surface, a rear portion of the protruding plate portion 71 of the CPA device 55 is pushed down. When the rear portion of the protruding plate portion 71 is pushed down, the CPA device 55 is inclined in a direction in which the arm portion 17 is pushed upward (in a direction of an arrow U) as illustrated in FIG. 2. That is, at the temporary locking position of the CPA device 55, the backlash filling protrusion 19 tilts the CPA device 55 in a direction in which a locking amount of the engagement protrusion 81 with respect to the lock portion 43 increases (a state shown illustrated in FIG. 2).

Next, an assembling procedure of the connector 11 will be described.

In the connector housing 13 into which the front holder 31 is not inserted, terminals (not illustrated) of the connector 11 are inserted into the respective terminal accommodating chambers 27 from the terminal inserting openings 29. When the terminals are inserted into predetermined positions, the elastically restored elastic flexible locking pieces 37 come into contact with the terminals, and the terminals are restricted from slipping out rearward. At this time, the CPA device 55 is at a temporary locking position where the locking portion 63 is locked to the locking protrusion 61 and the engagement protrusion 81 abuts against (or is close to the locking portion 43 with a clearance) the lock portion 43.

When all the terminals are mounted on the respective terminal accommodating chambers 27, the front holder 31 is mounted on the front face of the connector housing 13. When the lance contact plates 35 are fitted into the retraction spaces 39, the front holder 31 restricts the movement of the elastic flexible locking pieces 37 in the unlocking direction and doubly prevents the terminal from slipping out.

When the mated connector is fitted into the connector 11, the lock claw (not illustrated) of the mated connector presses the lock portion 43 to push down the lock arm 23. When the fitting is completed, the lock claw of the mated connector passes through the lock portion 43 toward the rear face of the connector housing 13. Then, the lock arm 23 is elastically restored, the lock portion 43 locks the lock claw, and the mated connector and the connector 11 are fixed (locked) in a fitted state.

At this time, the lock claw that has passed through the lock portion 43 presses the engagement protrusion 81 downward. When the engagement protrusion 81 of the arm portion 17 is pressed, the extended free end 79 is swung in an arc locus. As a result, the arm portion 17 of the CPA device 55 is disengaged from the lock portion 43 and can move to the final locking position.

In the CPA device 55 sliding forward on the detection member mounting surface 57, the engagement protrusion 81 of the arm portion 17 is in sliding contact with a lower face of the lock portion 43. When the engagement protrusion 81 passes through the lock portion 43, the arm portion 17 swings upward by an elastic restoring force, and an upper face thereof abuts against the lock portion 43. When the CPA body portion 77 abuts against the CPA stopper wall 53, the movement of the CPA device 55 to the final locking position is completed.

Next, functions of the above configuration will be described.

In the connector 11 according to the present embodiment, the CPA device 55 is moved from the temporary locking position to the final locking position by engaging the protruding plate portion 71 with the guide groove 15 of the connector housing 13. The CPA device 55 includes the arm portion 17 extending in a direction of approaching the lock portion 43. The arm portion 17 includes the engagement protrusion 81 at the extended free end 79. When the engagement protrusion 81 of the arm portion 17 abuts against the lock portion 43 of the connector housing 13, the movement of the CPA device 55 to the final locking position is restricted. That is, the temporary locking position is reached.

Here, the CPA device 55 tilts when there is backlash between the connector housing 13 and the CPA device 55. When the CPA device 55 tilts, the locking amount of the engagement protrusion 81 with respect to the lock portion 43 is reduced since the engagement protrusion 81 is provided at the extended free end 79 of the arm portion 17. When the locking amount of the engagement protrusion 81 is reduced, the engagement with the lock portion 43 is likely to be released, and the CPA device 55 may shift to the unintended final locked state.

That is, the CPA device 55 slides along the guide groove 15 by engaging the protruding plate portion 71 with the guide groove 15. In order to slide on the guide groove 15, a slight clearance is required between the protruding plate portion 71 and the guide groove 15. Since the clearance exists, the CPA device 55 is inclined by a slight generated backlash. The inclination generated at a base end of the arm portion 17 is amplified at a distal end of the arm portion 17, and the CPA device 55 is operated as a large displacement in a direction in which the engagement protrusion 81 is disengaged from the lock portion 43.

In the CPA device 55, the backlash filling protrusion 19 is formed on the protruding plate portion 71 to be engaged with the guide groove 15. The backlash filling protrusion 19 tilts the CPA device 55, by using backlash caused by the clearance, in a direction in which the locking amount of the engagement protrusion 81 with respect to the lock portion 43 is increased.

As a result, in the CPA device 55, the displacement of the engagement protrusion 81 provided at the extended free end 79 of the arm portion 17 is amplified in a direction in which the locking amount with the lock portion 43 is increased. The CPA device 55 in which the locking amount with the lock portion 43 is increased is prevented from shifting to the unintended final locked state. As a result, the connector 11 can improve the operation reliability of the CPA device 55.

In the connector 11, the CPA device 55 slides on the detection member mounting surface 57 of the mounting wall portion 59 formed on the connector housing 13, and is moved from the temporary locking position to the final locking position. Here, at the temporary locking position, the movement of the CPA device 55 to the final locking position is restricted when the engagement protrusion 81 abuts against the lock portion 43. The movement of the CPA device 55 in the opposite direction (that is, the direction in which the CPA device 55 is detached from the detection member mounting surface 57) is restricted (prevented from slipping out) by locking the locking portion 63 to the locking protrusion 61 protruding on the detection member mounting surface 57.

Therefore, in the CPA device 55, when the mounting wall portion 59 formed in the connector housing 13 has a low strength due to a small thickness or the like, the locking protrusion 61 is displaced together with the mounting wall portion 59 in a direction in which the locking amount with the locking portion 63 is reduced.

In the connector 11, when the fitting with the mated housing is released, the CPA device 55 is moved to the temporary locking position. As described above, at the temporary locking position, the CPA device 55 is prevented from slipping out only by locking the locking portion 63 to the locking protrusion 61. When a part of a detaching force is applied to the CPA device 55 in this state, the CPA device 55 may detach from the detection member mounting surface 57 of the detection member mounting portion 51 in a case where the locking amount with the locking protrusion 61 is insufficient.

Therefore, in the connector 11, the support wall 21 is formed across the extended lower face of the mounting wall portion 59 and the connector housing 13. The support wall 21 can restrict the bending of the mounting wall portion 59 in a direction in which the locking protrusion 61 separates from the locking portion 63.

As a result, in the connector 11, when the CPA device 55 is at the temporary locking position, the detachment from the mounting wall portion 59 is prevented by firmly locking the locking portion 63 to the locking protrusion 61 even if a part of a connector detaching force is applied to the CPA device 55. As a result, the connector 11 can improve the operation reliability of the CPA device 55.

Next, a connector according to a second embodiment of the present invention will be described.

Figure 8:
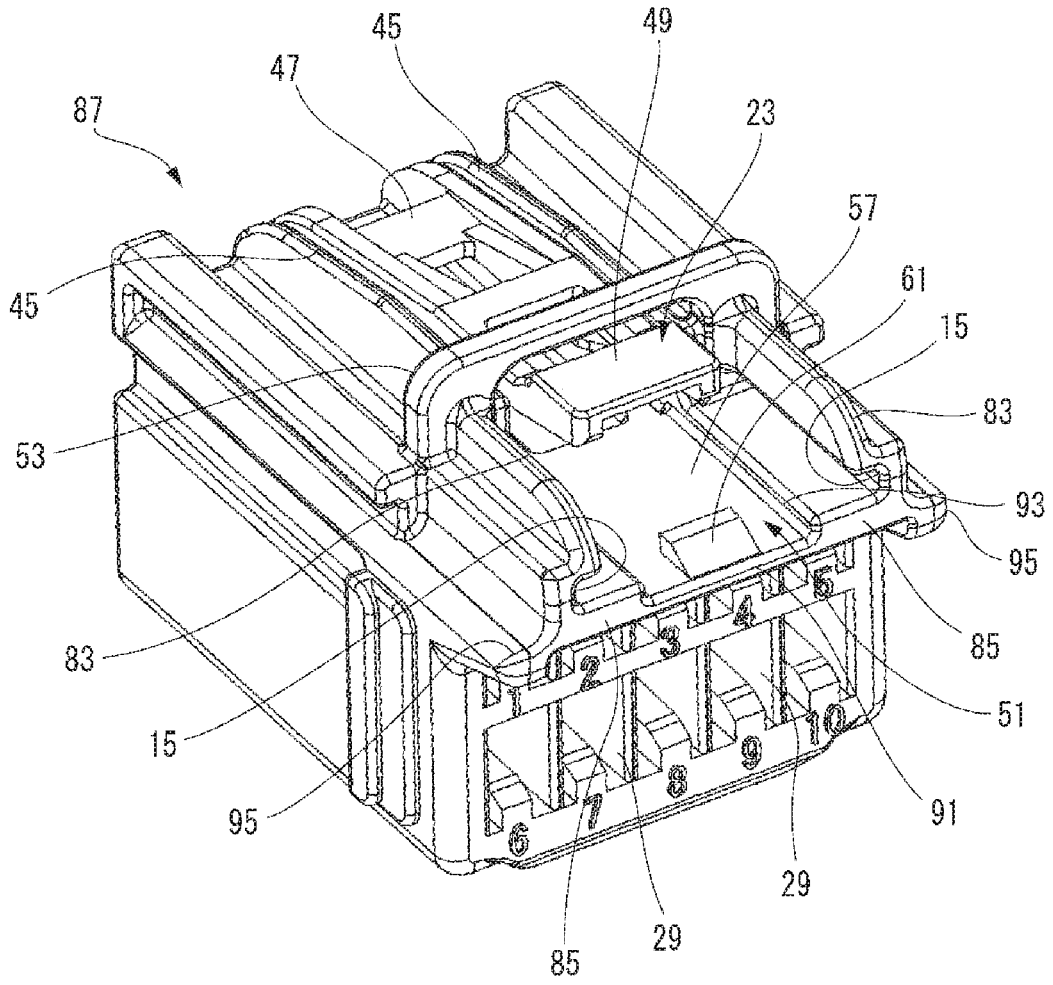
FIG. 8 is a perspective view of a connector housing in a connector according to a second embodiment of the present invention when viewed from a rear upper side.

FIG. 8 is a perspective view of a connector housing 87 in the connector according to the second embodiment of the present invention when viewed from a rear upper side. In the second embodiment, the same members as those in the first embodiment are denoted by the same reference numerals, and a repetitive description thereof will be omitted. The connector housing 87 of the connector according to the second embodiment includes a thickening portion 85. A bottom-plate lower-face protruding portion 89 (see FIG. 4) connected to the base end of the arm portion 17 is formed on the bottom plate portion 65, facing the detection member mounting surface 57, of the CPA device 55. The bottom-plate lower-face protruding portion 89 is in sliding contact with the detection member mounting surface 57. A rear end face of the bottom-plate lower-face protruding portion 89 serves as the above locking portion 63. In the connector housing 87, both sides of the mounting wall portion 91 that sandwich a sliding contact path 93 to be in sliding contact with the bottom-plate lower-face protruding portion 89 serve as the thickening portions 85 that are made thick.

In the connector according to the second embodiment, an outer edge portion 95 of each of the thickening portions 85, which is on a side opposite to the sliding contact path 93, is formed to be thicker than the sliding contact path 93 and is connected to a rear end face of the connector housing 87.

In the connector according to the second embodiment, the CPA device 55 slides on the detection member mounting surface 57 of the mounting wall portion 91 formed in the connector housing 87 and is moved from the temporary locking position to the final locking position. Here, at the temporary locking position, the movement of the CPA device 55 to the final locking position is restricted when the engagement protrusion 81 abuts against the lock portion 43. The movement of the CPA device 55 in the opposite direction (that is, the direction in which the CPA device 55 is detached from the detection member mounting surface 57) is restricted (prevented from slipping out) by locking the locking portion 63 to the locking protrusion 61 protruding on the detection member mounting surface 57.

Figure 9:
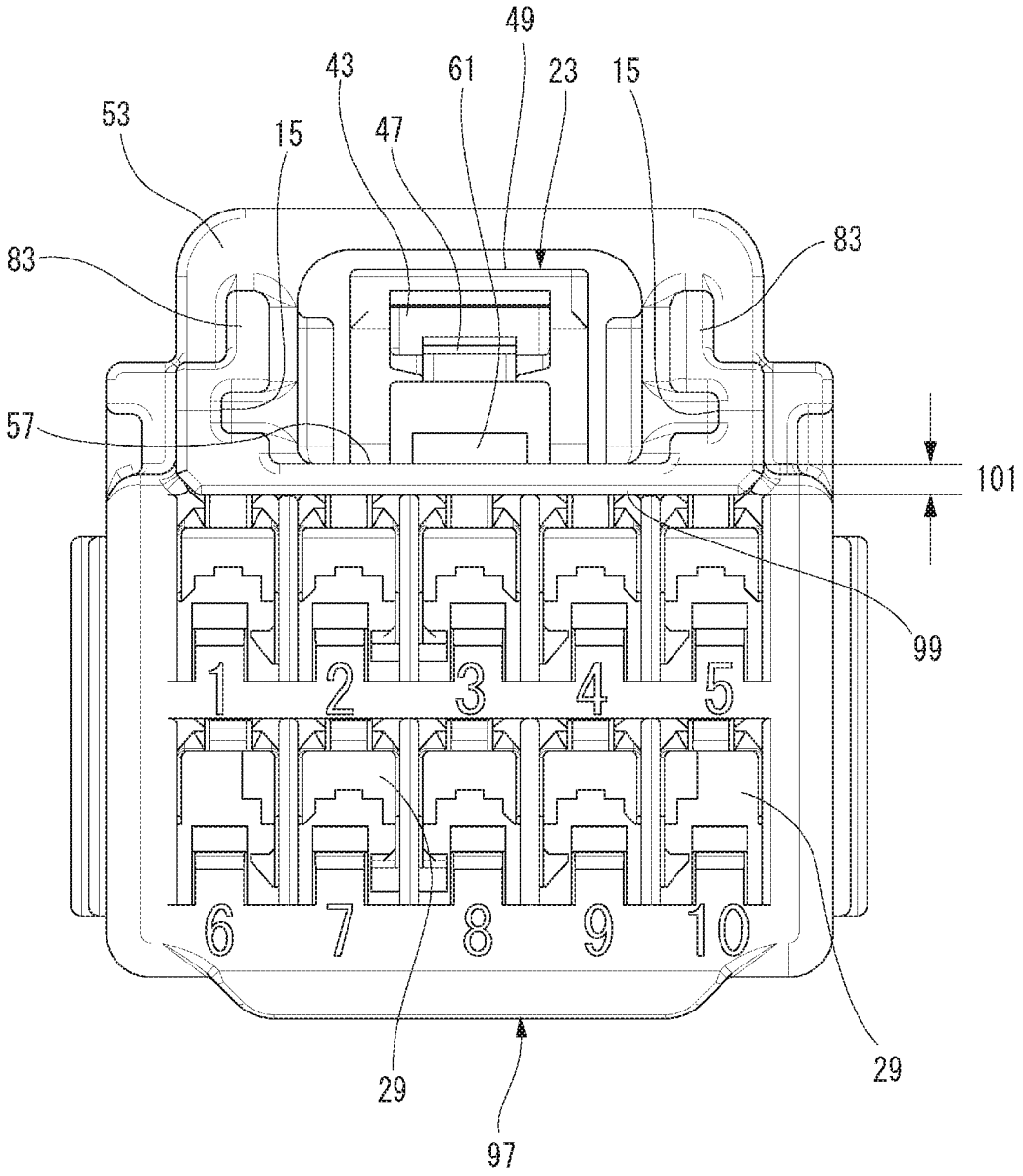
FIG. 9 is a back view of a connector housing according to a reference example before increasing the thickness.
Figure 10:
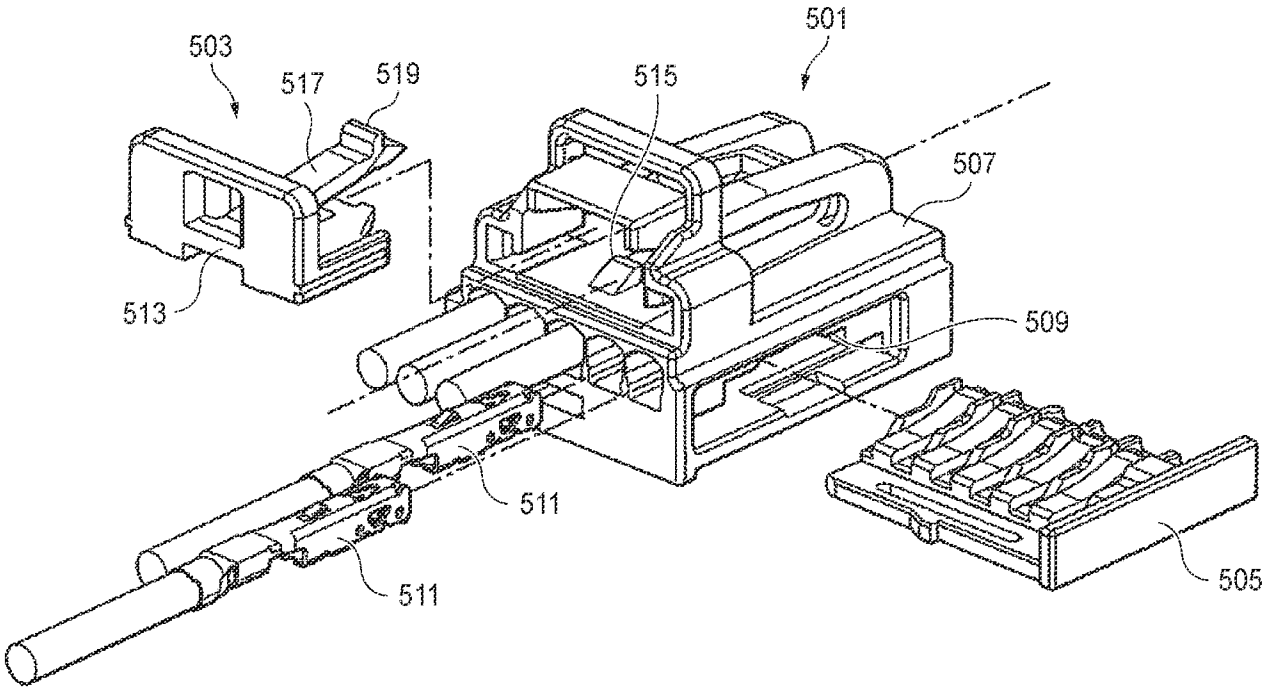
FIG. 10 PRIOR ART
FIG. 10 is an exploded perspective view of an electric connector according to the related art, which includes a CPA device.

FIG. 9 is a back view of a connector housing 97 according to a reference example before increasing the thickness.

In the CPA device 55, when a mounting wall portion 99 formed on the connector housing 97 includes a thin portion 101, the mounting wall portion 99 has a low strength. In such a connector housing 97, the locking protrusion 61 is displaced together with the mounting wall portion 99 in a direction in which the locking amount with the locking portion 63 is reduced.

In the connector according to the reference example, when the fitting with the mated housing is released, the CPA device 55 is moved to the temporary locking position. As described above, at the temporary locking position, the CPA device 55 is prevented from slipping out only by locking the locking portion 63 to the locking protrusion 61. When a part of a detaching force is applied to the CPA device 55 in this state, the CPA device 55 may detach from the detection member mounting surface 57 of the detection member mounting portion 51 in a case where the locking amount with the locking protrusion 61 is insufficient.

Therefore, in the connector housing 87 according to the second embodiment, the mounting wall portion 91 including the detection member mounting surface 57 serves as the thickening portions 85 thicker than the sliding contact path 93 at both sides sandwiching the sliding contact path 93. The mounting wall portion 91 includes the thickening portion 85, so that the mounting wall portion 91 has high strength. Since the mounting wall portion 91 has high strength, the locking protrusion 61 is less likely to be displaced in a direction in which the locking amount with the locking portion 63 is reduced.

Accordingly, in the connector according to the second embodiment, when the CPA device 55 is at the temporary locking position, the detachment from the mounting wall portion 91 is prevented by firmly locking the locking portion 63 to the locking protrusion 61 even if a part of a connector detaching force is applied to the CPA device 55. As a result, the connector including the connector housing 87 according to the second embodiment can improve the operation reliability of the CPA device 55.

In the connector according to the second embodiment, the outer edge portion 95 of each of the thickening portions 85, which is on the side opposite to the sliding contact path 93, is formed to be thicker than the sliding contact path 93 and is connected to the rear end face of the connector housing 87. That is, the mounting wall portion 91 is also reinforced by the outer edge portions 95 in addition to the above thickening portions 85. Accordingly, the mounting wall portion 91 has higher strength, and the locking protrusion 61 is less likely to be displaced in a direction in which the locking amount with the locking portion 63 is reduced.

As a result, the connector including the connector housing 87 according to the second embodiment can further improve the operation reliability of the CPA device 55.

In addition, in the connector housing 87 according to the second embodiment, the support wall 21 in the connector housing 13 according to the first embodiment can be omitted. Therefore, when the terminal is inserted into the terminal accommodating chamber 27, the fingers do not be interfered by the support wall 21, and workability during the insertion of terminals can be improved.

Therefore, the connector 11 according to each of the above embodiments can improve the operation reliability of the CPA device 55.

The present invention is not limited to the above-described embodiments and may be appropriately modified, improved, or the like. Additionally, materials, shapes, sizes, numbers, arrangement locations, and the like of elements in the above embodiments are optional and are not limited as long as the present invention can be implemented.

Here, characteristics of the embodiments of the connector according to the present invention described above are briefly summarized in the following [1] to [4], respectively.

[1]

A connector (11) including:

a connector housing (13, 87) that includes a lock portion (43) for locking a mated housing;

a guide groove (15) that is formed in the connector housing (13) and guides a fitting detection member (a CPA device 55) from a temporary locking position to a final locking position;

an arm portion (17) that includes an engagement protrusion (81) provided on an extended free end (79) of the arm portion and abutting against the lock portion (43) at the temporary locking position, the extended free end (79) extending from the fitting detection member (the CPA device 55) in a direction of approaching the lock portion (43); and a backlash filling protrusion (19) that is formed on a protruding plate portion (71), to be engaged with the guide groove (15), of the fitting detection member (the CPA device 55), and is used for titling the fitting detection member (the CPA device 55) in a direction in which a locking amount of the engagement protrusion (81) with respect to the lock portion (43) is increased at the temporary locking position.

According to the connector having the configuration of the above [1], the fitting detection member is moved from the temporary locking position to the final locking position by engaging the protruding plate portion with the guide groove of the connector housing. The fitting detection member includes the arm portion extending in a direction of approaching the lock portion. The arm portion includes the engagement protrusion at the extended free end. When the engagement protrusion of the arm portion abuts against the lock portion of the connector housing, the movement of the fitting detection member to the final locking position is restricted.

Here, the fitting detection member tilts when there is backlash between the connector housing and the fitting detection member. When the fitting detection member tilts, the locking amount of the engagement protrusion with respect to the lock portion is reduced since the engagement protrusion is provided at the extended free end of the arm portion. When the locking amount of the engagement protrusion is reduced, the engagement with the lock portion is likely to be released, and the fitting detection member may shift to the unintended final locked state.

That is, the fitting detection member slides along the guide groove by engaging the protruding plate portion with the guide groove. In order to slide on the guide groove, a slight clearance is required between the protruding plate portion and the guide groove. Since the clearance exists, the fitting detection member is inclined by a slight generated backlash. The inclination generated at a base end of the arm portion is amplified at a distal end of the arm portion, and the fitting detection member is operated as a large displacement in a direction in which the engagement protrusion is disengaged from the lock portion.

In the fitting detection member, the backlash filling protrusion is formed in the protruding plate portion to be engaged with the guide groove. The backlash filling protrusion tilts the fitting detection member, by using backlash caused by the clearance, in a direction in which the locking amount of the engagement protrusion with respect to the lock portion is increased.

Accordingly, in the fitting detection member, the displacement of the engagement protrusion provided on the extended free end of the arm portion is amplified in a direction in which the locking amount with the lock portion is increased. The fitting detection member in which the locking amount with the lock portion is increased is prevented from shifting to the unintended final locked state. As a result, the connector can improve the operation reliability of the fitting detection member.

[2]

The connector (11) according to the above [1], further including:

a mounting wall portion (59) that is formed in the connector housing (13) and includes a detection member mounting surface (57) on which the fitting detection member (the CPA device 55) is slid from the temporary locking position to the final locking position, and extends from the connector housing (13);

a locking protrusion (61) that protrudes on the detection member mounting surface (57) and restricts detachment of the fitting detection member (the CPA device 55) from the detection member mounting surface (57) by locking the fitting detection member (the CPA device 55) when the fitting detection member (the CPA device 55) is at the temporary locking position; and a support wall (21) that is formed across an extended lower face of the mounting wall portion (59) and the connector housing (13).

According to the connector having the configuration of the above [2], the fitting detection member slides on the detection member mounting surface of the mounting wall portion formed on the connector housing, and is moved from the temporary locking position to the final locking position. Here, at the temporary locking position, the movement of the fitting detection member to the final locking position is restricted when the engagement protrusion abuts against the lock portion, and the movement of the fitting detection member in the opposite direction (that is, the direction in which the fitting detection member is detached from the detection member mounting surface) is restricted (prevented from slipping out) by locking the locking portion to the locking protrusion protruding on the detection member mounting surface.

Therefore, in the fitting detection member, when the mounting wall portion formed in the connector housing has a low strength due to a small thickness or the like, the locking protrusion is displaced together with the mounting wall portion in a direction in which the locking amount with the locking portion is reduced.

In the connector having the present configuration, when the fitting with the mated housing is released, the fitting detection member is moved to the temporary locking position. As described above, at the temporary locking position, the fitting detection member is prevented from slipping out only by locking the locking portion to the locking protrusion. When a part of a detaching force is applied to the fitting detection member in this state, the fitting detection member may detach from the detection member mounting surface in a case where the locking amount with the locking protrusion is insufficient.

Therefore, in the connector, the support wall is formed across the extended lower face of the mounting wall portion and the connector housing. The support wall can restrict the bending of the mounting wall portion in a direction in which the locking protrusion separates from the locking portion.

As a result, in the connector, when the fitting detection member is at the temporary locking position, the detachment from the mounting wall portion is prevented by firmly locking the locking portion to the locking protrusion even if a part of a connector detaching force is applied to the fitting detection member. As a result, the connector can improve the operation reliability of the fitting detection member.

[3]

The connector (11) according to the above [1] further including:

a mounting wall portion (91) that is formed in the connector housing (87) and includes a detection member mounting surface (57) on which the fitting detection member (the CPA device 55) slides from the temporary locking position to the final locking position, and extends from the connector housing (87);

a bottom-plate lower-face protruding portion (89) that is formed on a bottom plate portion (65), facing the detection member mounting surface (57), of the fitting detection member (the CPA device 55), and is connected to a base end of the arm portion (17) and is in sliding contact with the detection member mounting surface (57); and thickening portions (85) that are formed on the mounting wall portion (91) and are obtained by thickening both sides sandwiching a sliding contact path (93) that is in sliding contact with the bottom-plate lower-face protruding portion (89).

According to the connector having the configuration of the above [3], the fitting detection member slides on the detection member mounting surface of the mounting wall portion formed on the connector housing, and is moved from the temporary locking position to the final locking position. Here, at the temporary locking position, the movement of the fitting detection member to the final locking position is restricted when the engagement protrusion abuts against the lock portion, and the movement of the fitting detection member in the opposite direction (that is, the direction in which the fitting detection member is detached from the detection member mounting surface) is restricted (prevented from slipping out) by locking the locking portion to the locking protrusion protruding on the detection member mounting surface.

Therefore, in the fitting detection member, when the mounting wall portion formed in the connector housing has a low strength due to a small thickness or the like, the locking protrusion is displaced together with the mounting wall portion in a direction in which the locking amount with the locking portion is reduced.

In the connector having the present configuration, when the fitting with the mated housing is released, the fitting detection member is moved to the temporary locking position. As described above, at the temporary locking position, the fitting detection member is prevented from slipping out only by locking the locking portion to the locking protrusion. When a part of a detaching force is applied to the fitting detection member in this state, the fitting detection member may detach from the detection member mounting surface in a case where the locking amount with the locking protrusion is insufficient.

Therefore, in the connector having the present configuration, the fitting detection member is maintained at the temporary locking position by placing the bottom-plate lower-face protruding portion formed on the bottom plate portion on the sliding contact path of the detection member mounting surface. Here, in the connector housing, the mounting wall portion including the detection member mounting surface serves as thickening portions, which are thicker than the sliding contact path, at both sides sandwiching the sliding contact path. The mounting wall portion includes the thickening portion, so that the mounting wall portion has high strength. Since the mounting wall portion has high strength, the locking protrusion is less likely to be displaced in a direction in which the locking amount with the locking portion is reduced.

As a result, in the connector having the present configuration, when the fitting detection member is at the temporary locking position, the detachment from the mounting wall portion is prevented by firmly locking the locking portion to the locking protrusion even if a part of a connector detaching force is applied to the fitting detection member. As a result, the connector can improve the operation reliability of the fitting detection member.

[4]

The connector (11) according to the above[3], in which an outer edge portion (95) of each of the thickening portions (85) on a side opposite to the sliding contact path (93) is formed to be thicker than the sliding contact path (93), and is connected to a rear end face of the connector housing (87).

According to the connector having the configuration of the above [4], the outer edge portion of the thickening portion on the side opposite to the sliding contact path is formed to be thicker than the sliding contact path, and is connected to the rear end face of the connector housing. That is, the mounting wall portion is also reinforced by the outer edge portions in addition to the above thickening portions. Accordingly, the mounting wall portion has higher strength, and the locking protrusion is less likely to be displaced in a direction in which the locking amount with the locking portion is reduced.

As a result, the connector having the present configuration can improve the operation reliability of the fitting detection member.

The connector according to the present invention can improve operation reliability of a fitting detection member.

What is claimed is:

1. A connector comprising:

a connector housing that includes a lock portion configured to lock a mated housing;

a guide groove that is formed in the connector housing and guides a fitting detection member from a temporary locking position to a final locking position;

an arm portion that includes an engagement protrusion provided on an extended free end of the arm portion and abutting against the lock portion at the temporary locking position, the extended free end extending from the fitting detection member in a direction of approaching the lock portion; and a backlash filling protrusion that is formed on a protruding plate portion, to be engaged with the guide groove, of the fitting detection member, and is configured to tilt the fitting detection member in a direction in which a locking amount of the engagement protrusion with respect to the lock portion is increased at the temporary locking position.

2. The connector according to claim 1, further comprising:

a mounting wall portion that is formed in the connector housing, includes a detection member mounting surface on which the fitting detection member is slid from the temporary locking position to the final locking position, and extends from the connector housing;

a locking protrusion that protrudes on the detection member mounting surface and is configured to restrict detachment of the fitting detection member from the detection member mounting surface by locking the fitting detection member when the fitting detection member is at the temporary locking position; and a support wall that is formed across an extended lower face of the mounting wall portion and the connector housing.

3. The connector according to claim 1, further comprising:

a mounting wall portion that is formed in the connector housing, includes a detection member mounting surface on which the fitting detection member slides from the temporary locking position to the final locking position, and extends from the connector housing;

a bottom-plate lower-face protruding portion that is formed on a bottom plate portion, facing the detection member mounting surface, of the fitting detection member, and is connected to a base end of the arm portion and is in sliding contact with the detection member mounting surface; and thickening portions that are formed on the mounting wall portion and are obtained by thickening both sides sandwiching a sliding contact path that is in sliding contact with the bottom-plate lower-face protruding portion.

4. The connector according to claim 3, wherein an outer edge portion of each of the thickening portions on a side opposite to the sliding contact path is formed to be thicker than the sliding contact path, and is connected to a rear end face of the connector housing.

* * * * *